United States Patent [19]

Riegelman

[11] 4,185,479

[45] Jan. 29, 1980

[54] LOCKING HANDLE FOR SLIDING DOORS AND THE LIKE

[75] Inventor: Harry M. Riegelman, Fullerton, Calif.

[73] Assignee: Rusco Industries, Inc., Fullerton, Calif.

[21] Appl. No.: 899,793

[22] Filed: Apr. 25, 1978

[51] Int. Cl.[2] ..... E05B 65/08

[52] U.S. Cl. ..... 70/95; 292/182

[58] Field of Search ..... 70/81, 90, 95, 97, 99, 70/100, DIG. 54, DIG. 80, ; 292/169 R, 182

[56] References Cited

U.S. PATENT DOCUMENTS

| | | | |
|---|---|---|---|
| 2,006,922 | 7/1935 | Jacobi | 70/81 |
| 2,163,307 | 6/1939 | Hart | 70/81 |
| 3,213,652 | 10/1965 | Tucker | 70/97 |
| 3,821,884 | 7/1974 | Walsh | 70/95 |

FOREIGN PATENT DOCUMENTS

| | | | |
|---|---|---|---|
| 753150 | 7/1956 | United Kingdom | 292/182 |

*Primary Examiner*—Mervin Stein
*Assistant Examiner*—Carl Pietruszka
*Attorney, Agent, or Firm*—Perry E. Turner

[57] ABSTRACT

In the embodiment shown is a handle to be mounted on a door stile, wherein the handle houses a latch plate, a bowed leaf spring interlocked with the latch plate, and a cam bar for moving the latch plate from one to the other of two positions, the cam bar being of such a length that one end thereof extends beyond one end of the handle when in one position and the other end thereof extends beyond the other end of the handle when in its other position. In both positions of the latch plate, its face is in a plane parallel to and confronts the stile. The latch plate has portions at one edge engaging an inner wall of the housing formed by the handle, and an elongated portion extending from such one edge passes through an opening in the wall and has a lip for latching to a jamb. When the door is closed, the cam bar in one position overcomes the spring to force the latch plate away from the jamb, and in the other position to permit the spring to position the latch plate wherein the lip thereof latches to the jamb. Since the latch plate bears against the wall of the handle, load on the latch plate lip is distributed to such wall and then to the stile and jamb. Also disclosed is a key lock option to be mounted to the exterior of the stile and operable via a key to effect movement of the cam bar to either of its two positions.

10 Claims, 14 Drawing Figures

FIG. 7
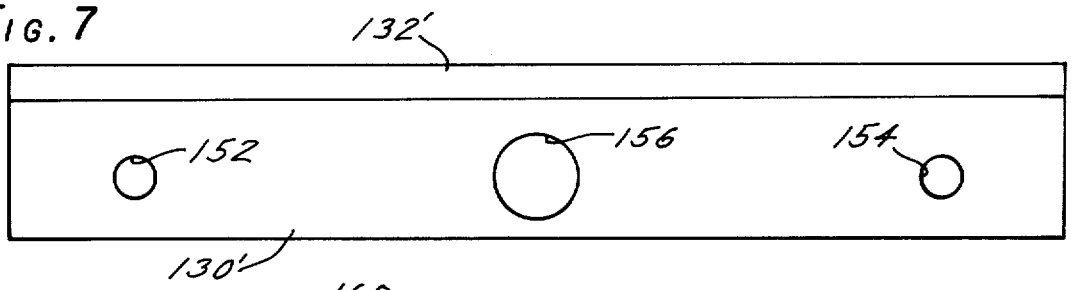
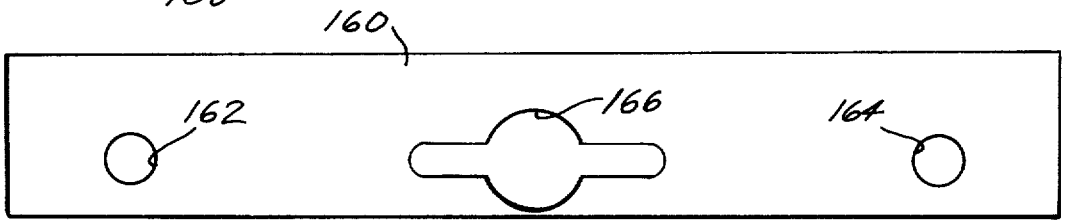
FIG. 8
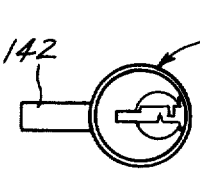
FIG. 9
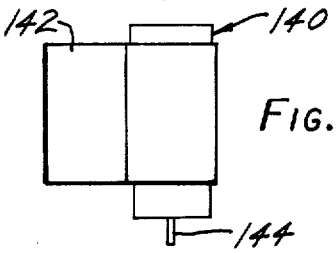
FIG. 10
FIG. 12
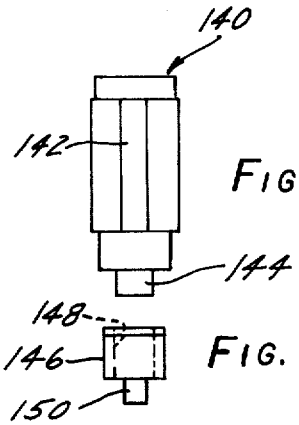
FIG. 11
FIG. 13
FIG. 14
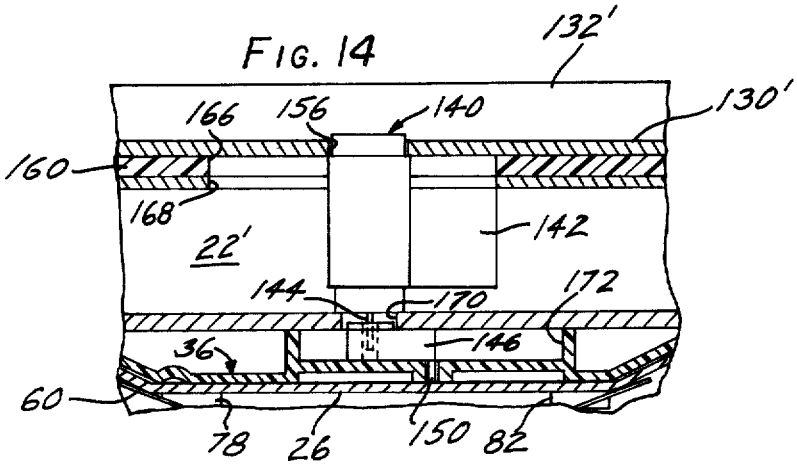

LOCKING HANDLE FOR SLIDING DOORS AND THE LIKE

BACKGROUND OF THE INVENTION

1. Field of the Invention

This invention relates to locking handles for sashes such as sliding doors and windows and the like.

2. Description of the Prior Art

As heretofore known, locking handles for sliding sashes are multi-element structures having latch or catch elements that are rotated into and out of latching position. Typically the latch element is rotatable in the handle which is secured to the door stile, and the jamb has an opening or protuberance with which the latch element is rotatable into and out of latching relation. Such locking handles are comprised of an undesired number of parts including bias springs for the latch elements, rotary knobs or cranks, and couplings utilizing cams, springs or rack-and-pinion devices by which to orient the latch elements as the knobs are rotated. Further, the latch elements typically are catch pins for latching to a portion of a door jamb, and represent undesirably small, and therefore relatively weak, parts to withstand substantial loading when the handle is subjected to suddent violent force in an effort to force to door open.

SUMMARY OF THE INVENTION

This invention embraces a locking or latching handle for sliding sashes in which a latch plate housed in the handle and having a latch portion extending to the exterior thereof is biased to one of two positions by a spring, and a cam bar movable longitudinally of the plate for forcing the plate to the other of the two positions, the latch portion of the plate being in position to latch to a jamb in one of the two positions of the plate. Also embraced by this invention is a single bowed spring interlocked with the latch plate for normally urging the plate to the one position, and which has the additional function of a shock absorber for the latch plate to prevent damage thereto when the door is inadvertently closed while the plate is in latching position. Still further, this invention embraces a key lock mechanism mounted in the handle structure and stile, and having a key element engaging the cam bar, such mechanism being operable from the exterior of the door to move the cam bar to either of its two positions and thereby move the latch plate from latching to unlatching position.

BRIEF DESCRIPTION OF THE DRAWINGS

FIG. 7 is a top plan view of the exterior handle for use in moving the door from the outside;

FIG. 8 is a top plan view of a spacer plate used between the exterior handle and the stile when employing a key lock mechanism in accordance with the invention for operating the latch plate from the exterior, showing the central opening with integral keyway for a key bar of the lock mechanism;

FIG. 9 is a top plan view of the lock mechanism;

FIG. 10 is a side elevation view of the lock mechanism;

FIG. 11 is an elevation view of the lock mechanism as viewed from the left of FIG. 10;

FIG. 12 is a side elevation view of the cam bar actuator that is operable by the lock mechanism;

FIG. 13 is an end view of the actuator as seen from the left of FIG. 12; and

FIG. 14 is a fragmentary sectional view of the assembled locking handle and key lock mechanism in position on the stile, showing the parts positioned so that a key inserted and turned in the lock moves the cam bar via the actuator to force the latch plate to open position.

Referring to FIG. 1, a locking handle 20 of the invention is secured to the stile 22 of a sash such as a sliding glass door 24. The handle structure houses a latch plate 26 which has a latching portion extending out of the handle. In one position of the latch plate 26, the latching portion projects over and against a raised rib 30 of a stationary jamb 32. In the arrangement shown, a bar 36 has one end extending out of the lower end of the handle structure, and is adapted to be forced upwardly to cam the latch plate 26 out of interference relation with the rib 30 of the jamb 32 and thereby permit the sash 24 to be moved left to open it.

When the lower end of the cam bar 36 is pushed upward, its upper end (shown in dotted lines) extends out of the upper end of the handle structure. Manual force applied to the upper end of the bar 36 forces it to the position shown in solid lines, wherein such lower end extends out of the handle and causes the latch plate to move to the locking or latching position.

Figure 1:
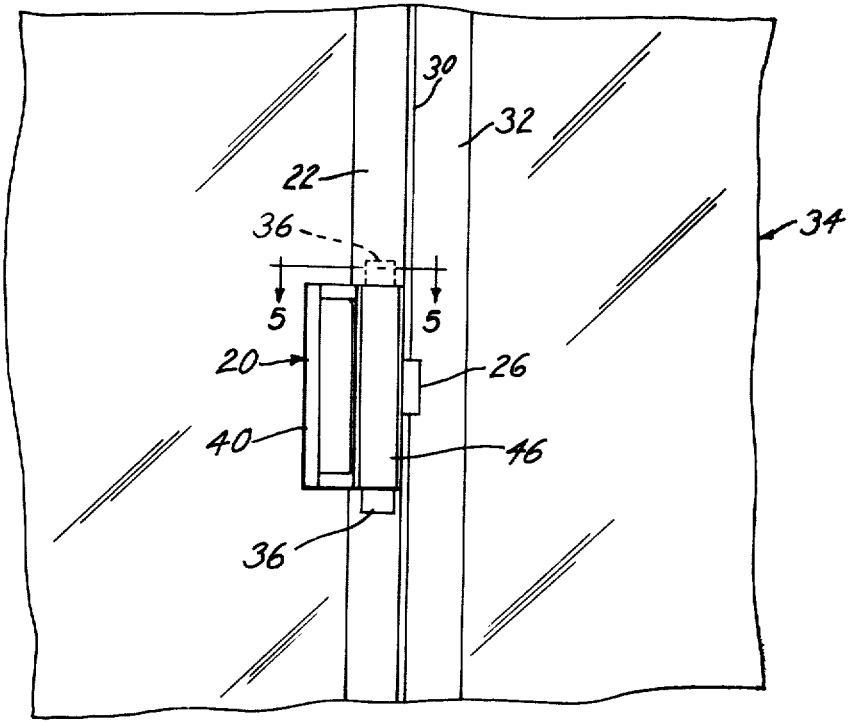
FIG. 1 is a view in elevation, from the inside, of the portions of a sliding door and fixed window surrounding a locking handle of the invention, showing the lip of the latch plate in latching engagement with a rib of the jamb.
Figure 2:
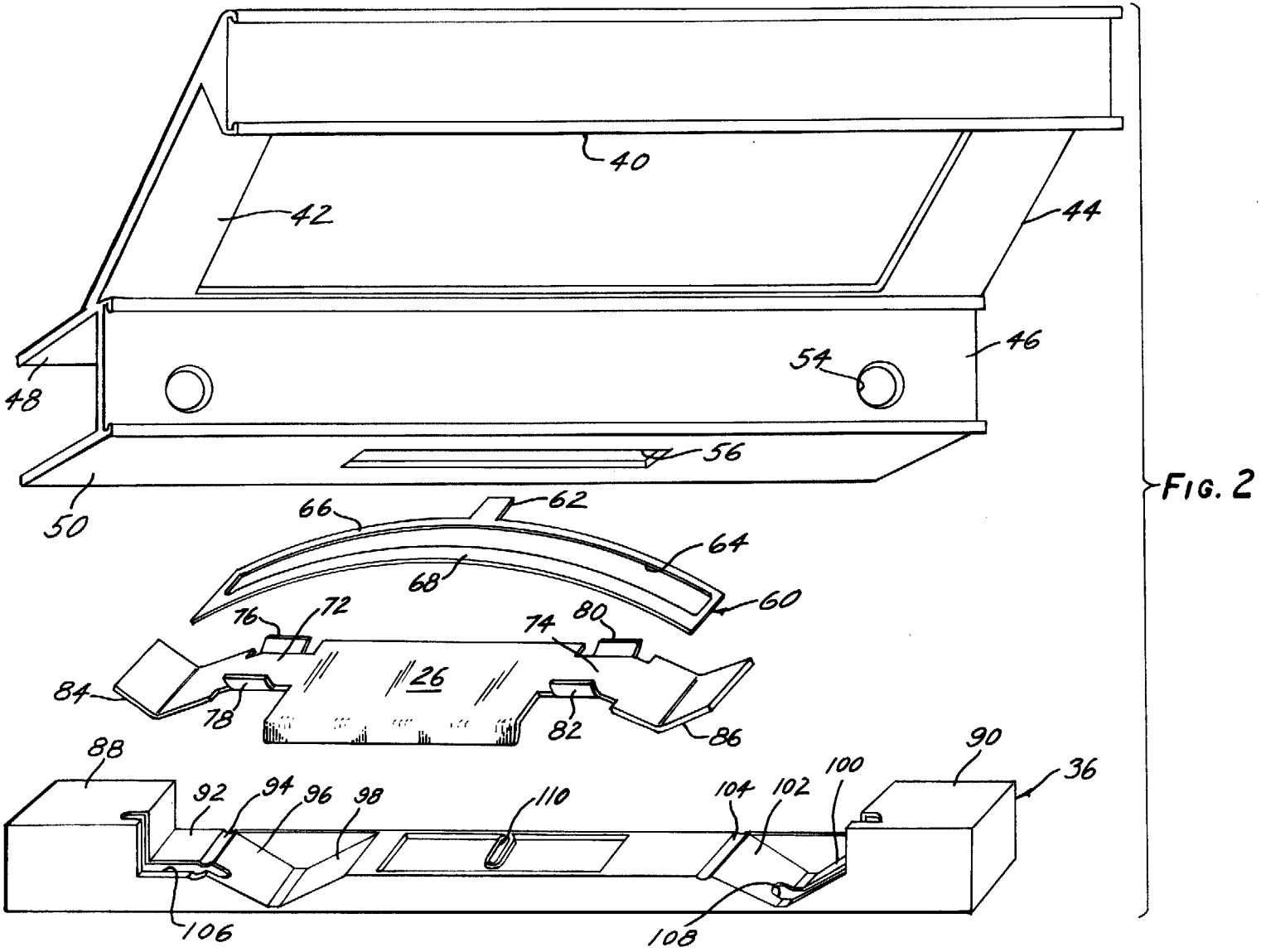
FIG. 2 is an exploded view of the handle and the three elements housed therein in accordance with the invention.

In addition to the three parts shown in FIG. 1, the locking handle of the invention also includes a spring member for normally urging the latch plate to one of its latching and unlatching positions. Referring to FIG. 2 along with FIG. 1, the illustrated handle has a hand grip bar portion 40 which is connected via end plates 42, 44 to one side of a channel that is formed of a center plate or web 46 and walls 48, 50. As shown, the web 46 has openings 52, 54 adjacent its ends, to receive fastening or clamping means to be described. The wall 50 has an elongated opening or slot 56 through which the latch plate extension projects. As will be observed, the ends of the slot 56 are limit stops for the ends of the projecting latch plate portion, and hence prevent longitudinal movement of the latch plate 26 as the cam bar 36 is moved from one to the other of its two positions.

In the embodiment shown, the spring previously referred to is a bowed, rectangular leaf spring 60 from one edge of which extends a substantially flat finger 62.

The body of the spring has a rectangular opening 64 of such size and location that the edge portion 66 from which the finger 62 extends is relatively narrow, and the opposite edge portion is a band 68 that includes the bulk of the material of the body of the spring. In one example, the spring 60 is a stamping of stainless steel 0.020-in. thick, with the body of the spring 3.50-in. long and 0.688-in. wide; the opening 64 is 3.25-in.×0.250-in.; the edge portion 66 is 0.062-in. wide, and the band 68 is 0.376-in. wide; and the finger 62 extends 0.262-in. from the edge portion 66, and is 0.19-in. wide. The spring is formed with a bow on a 2.25-in. radius in this example.

The latch plate 26 has a flat center portion from which the latching extension extends from one edge and is bent as shown in FIG. 2. Extending from the ends of the flat center portion of the latch plate are flat portions 72, 74 of reduced width from the edges of which pairs of ears 76, 78 and 80, 82 are struck upwardly. The ends of the plate 26 terminate in V-shaped portions 84, 86 as shown. The plate 26 is rigid.

The cam bar 36 preferably is a molded plastic element, which in the embodiment shown has end block portions 88, 90. Extending from the end block 88 is a flat surface or ledge 92, a narrow, arcuate trough 94 and inclined walls 96, 98 which generally conform in slope to the sides of one of the V-shaped ends 84 of the latch plate 26. Extending from the end block 90 are inclined walls 100, 102 which generally conform to the slopes of the sides of the end portion 86 of the latch plate. At the upper edge of the inclined wall 102 is a narrow, arcuate trough 104. The distance between the bottoms of the V's formed by the inclined walls 96, 98 and 100, 102 is the same as the distance between the bottoms of the V-shaped end portions 84, 86 of the latch plate 26. This is also the same distance between the centers of the troughs 94, 104. Further, the distance between the end block 88 and the trough 94 is sufficient to permit the bottom of the end portion of the latch plate to rest in the trough 94 in one position of the cam bar 36.

To facilitate longitudinal movement of the cam bar 36, it is provided with respective elongated slots or openings 106, 108. As shown, the opening 106 at one end extends into the end block 88, along the ledge 92 and trough 94, and terminates at its other end in the inclined wall 96. The slot 108 at one end extends into the end block 90, from which it extends down the inclined wall 100 and terminates at its other end in the inclined wall 102.

The cam bar 36 also has a centrally located opening 110 in its top wall, such opening 110 being oblong with its longitudinal centerline extending transversely of the bar. As will be described hereinafter, the oblong opening is also utilized to effect longitudinal movement of the cam bar 36 via a key lock, from the exterior of the door.

Figure 4:
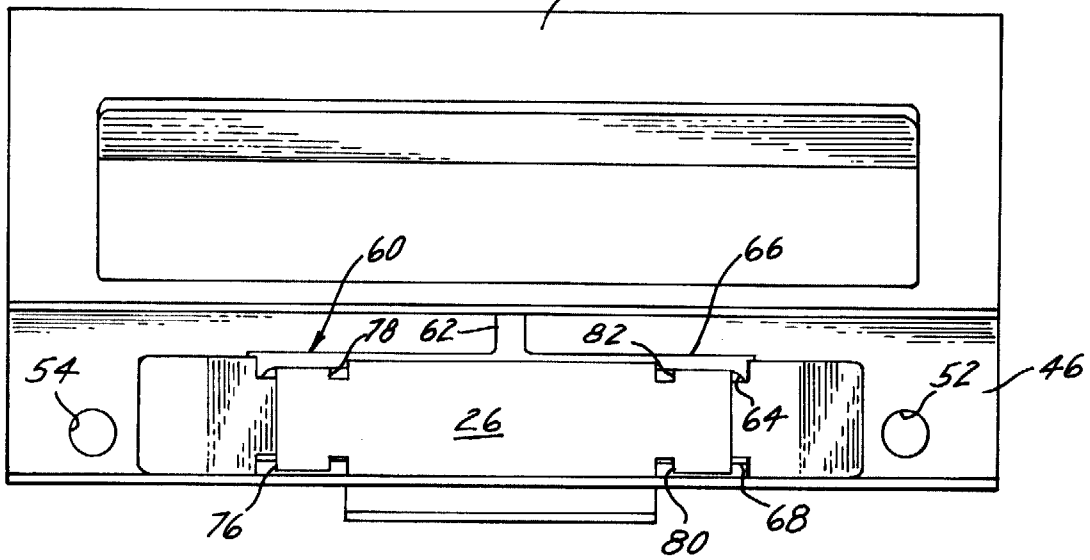
FIG. 4 is a bottom view of the handle showing the leaf spring and interlocked latch plate positioned therein.

The latch plate 26 and spring 60 are interlocked with the handle. Referring to FIG. 4, the spring is positioned in the channel of the handle with the finger 62 and mid-portion of the spring seated against the bottom or inside surface of the web 46 and the finger having its end abutting the inner surface of the wall 48. The latch plate is inserted in the channel with the pairs of ears 76, 78 and 80, 82 directed towards the spring, and the center latch tongue portion of the plate is manipulated to extend through the opening 56 in the wall 50 (see FIG. 2), and the pairs of ears are positioned with the ears 78, 82 on one edge of the plate extending through the opening 64 and against the inner edge of the portion 66 of the spring, and the other ears 76, 80 extending along the outer edge of the edge portion 68.

Figure 3:
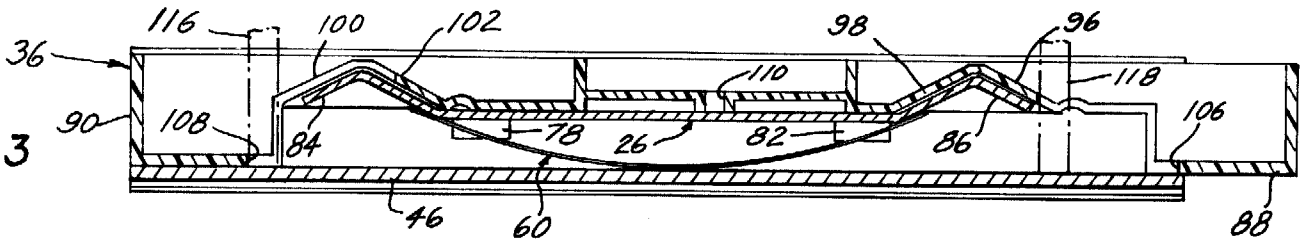
FIG. 3 is a longitudinal sectional view of the portion of the handle in which the elements shown in FIG. 2 are housed, showing such elements in the latching position of the latch plate.

FIG. 3 shows the interlocked spring 60 and latch plate 26, and also the cam bar 36 in position within the channel. The cam bar is shown in section along a line through the slots 106, 108, and in a position wherein the V-shaped ends 84, 86 of the latch plate 26 are located in the V's formed by the inclined walls 100, 102 and 96, 98 of the cam bar 36. In this position of the cam bar, the latch plate is in the lock position wherein, as explained in connection with FIG. 1, the latch plate can latchingly engage the rib of the jamb, i.e., when the door stile is brought against the jamb and the cam bar is moved to the position shown in FIG. 3.

The position from which the cam bar would be so moved is that in which the cam bar in FIG. 3 is moved to the left to the position wherein the troughs 104, 94 have the apices of the V-shaped ends 84, 86 therein. In this regard, it will be observed that movement of the cam bar 36 to the left from the position shown in FIG. 3 causes the inclined walls 102, 96 to cam the V's 84, 86 downward, and hence the latch plate downward, against the spring 60. Such downward movement of the latch plate and the spring causes the projecting portion of the latch plate to be retracted from the latching or locking position. The longitudinal movement of the cam bar in effecting such action of the latch plate is facilitated via posts extending through the slots 108, 106, such posts being shown in phantom at 116, 118. It should be noted that when the cam bar 36 is in its left position and the latch plate is forced downwardly against the spring, the external latching portion of the latch plate is moved away from the latching position, i.e., the latch plate is in the open position wherein, if the door is closed to bring the stile against the jamb, the latch plate is retracted so as not to lock with the rib on the jamb. Also, it should be noted that the posts 116, 118 act as stops to limit travel of the cam plate, i.e., overtravel of the cam bar is prevented between the ends of the slots 106, 108 abut the posts in such extreme positions.

Figure 5:
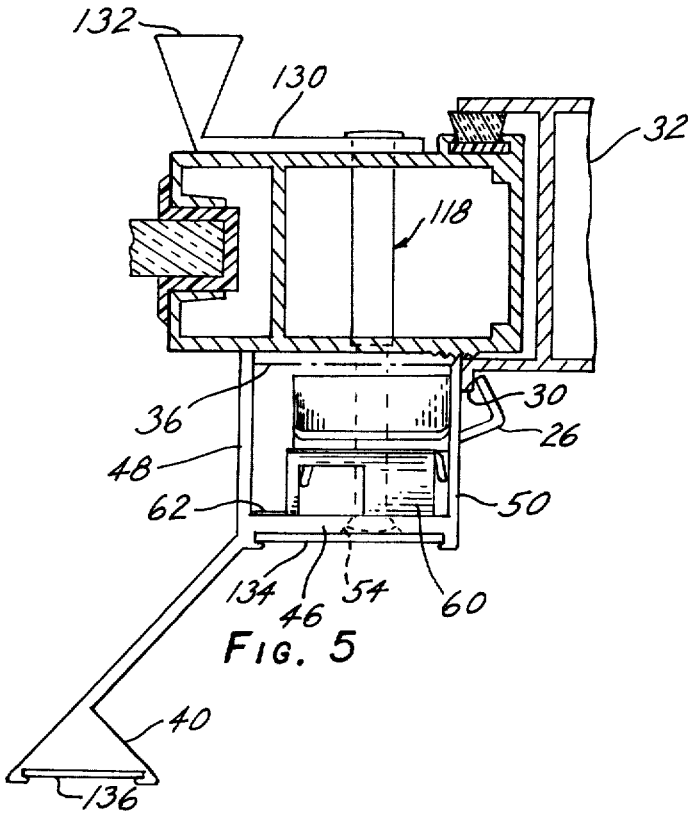
FIG. 5 is a sectional view taken along the line 5—5 of FIG. 1, with the cam bar in phantom, showing the positions of the elements in the latching position of the latch plate.
Figure 6:
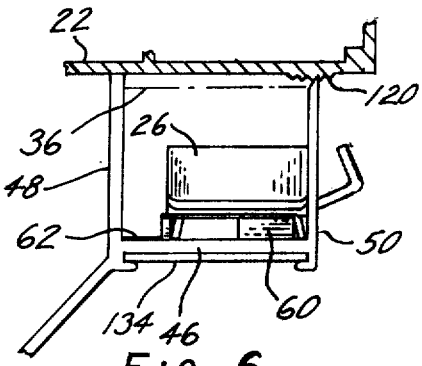
FIG. 6 is a fragmentary sectional view like FIG. 5, showing the spring and latch plate in the position to which they are forced by the cam bar for the open position of the latch plate.

FIGS. 5 and 6 illustrate the two positions for the latch plate 26 and spring 60, FIG. 5 showing these interlocked elements in the latching position, and FIG. 6 showing them in the unlatching position. FIG. 6 also shows the handle secured in position on the stile 22. In this latter regard, the stile in the illustrated arrangement is formed with a number of grooves or serrations 120 in one surface, and one wall 50 of the handle has its edge beveled or otherwise shaped with a narrow or sharp edge to nest in a groove 120. After the spring 60, latch plate 26 and cam bar 36 (such cam bar being shown in phantom in FIGS. 5 and 6) are assembled as above described, the handle is positioned as shown in FIG. 5 with the walls 48, 50 abutting the grooved or serrated surface of the stile 22.

Opposed walls of the stile 22 have spaced pairs of coaxial openings therethrough with which the spaced openings 52, 54 in the web 46 are aligned. In this regard, the handle is positioned against the stile with the edge of the wall 50 in the groove 120 that accommodates the needed alignment, whereupon the posts can be passed through the openings thus aligned and secure the handle to the stile. In the arrangement shown, each of the posts is formed as a nut-and-bolt type fastener wherein the bolt is threaded into an elongated sleeve nut. As indicated in FIG. 5, the sleeve nut portion of the post is passed through the stile openings, and the bolt portion is passed through the handle and threaded into the sleeve nut portion. The heads on the sleeve nut portion and bolt portion assure that the parts located between them are firmly secured together.

In this particular arrangement, the hand grip is provided exteriorly of the door so it can be opened from the outside, as where the handle lock is opened and the door is closed by bringing the stile against the jamb. The hand grip shown comprises a flat plate 130 having a handle or grip portion 132, such plate 130 being placed against the external surface of the stile 22. The plate 130 is provided with spaced openings which are aligned with those in the stile and the web of the handle through which the posts extend. The head of the sleeve nut portion rests on the outer surface of the plate 130, and the head of the bolt portion nests in the opening in the web of the handle. The latter head is slotted or otherwise formed to facilitate turning via a screwdriver. The posts are each tightened to thereby unite the hand grip, stile and locking handle together.

It will be understood that the fastening means may be any of available ones, and may include self-tapping screws, conventional nut and bolt fasteners, adhesives, and the like. In an arrangement as shown, desirably the outer face of the web 46 of the channel, in which the openings 52, 54 and heads of the posts are accessible, is covered with a suitable escutcheon 134 and for which the handle may be formed with inturned flanges to permit the escutcheon to be slipped into place and captured by the flanges. If desired, the hand grip 40 may be similarly shaped to receive an escutcheon 136.

A locking handle in accordance with the invention is characterized by marked strength and solidity. Referring to FIGS. 1, 4 and 5, the edges of the V-shaped ends 84, 86 of the latch plate 26 are engageable or in abutment with the inner surface of the wall 50. With the cam bar 36 in position to effect interlocking of the lip of the latch plate 26 with the rib 30 of the jamb, any attempt to force the door open, whether intentionally from the outside or inadvertently from the inside, results in the force being transmitted to and distributed through the wall 50 and remainder of the handle, and to and through the stile 22 via the interlocking wall 50 and grooves 120, and thence to the jamb. This prevents the breaking or deforming of the latch plate, handle, stile or jamb. It should be noted that the invention avoids shear loads on the fasteners 116, 118. They merely clamp parts together. In a typical example of locking handle of the invention, the latch plate is 0.0625-in. thick with the projecting portion 2.0-in. long and the interior portion 4.75-in. long (formed from spring steel sheet stock 5.0-in. long). The handle is aluminum, its walls 48, 50 being 0.0625-in. thick. The rating of such latch handle is of the order of 1,000 pounds shear load, which is in sharp contrast to ratings of prior art latch handles of the order of 300 pounds shear load.

The spring 60 aids in preventing damage to the parts, as when the door is open and the cam bar 36 is in the position wherein the latch portion of the latch plate is in its lock position. If the door is moved to close it, the latch portion strikes the jamb. However, the spring acts as a cushion and permits the latch plate to retract inwardly and away from the wall 50 until the latch portion closes against the wall 50. Throughout these actions, the end of the finger 62 of the spring 60 remains against the wall 48, and the body portions of the spring engaged by the ears 76, 80 and 78, 82 of the latch plate resiliently deform and fulcrum about the inner end of the finger 62 to accommodate retracting movement of the latch plate. The energy stored in the spring immediately returns the latch plate and spring to normal position when the projecting lip is clear of the jamb.

FIGS. 7–14 illustrate a sash lock handle in accordance with this invention wherein the position of the latch plate is also controllable via a key lock operable from the outside of the sash. In this regard, FIG. 9 shows the top view of a key lock 140 into which a key (not shown) is to be inserted. In this arrangement, a keeper plate or bar 142 is welded to the body of the lock 140. As shown in FIGS. 10 and 11, a flat rectangular member 144 extends out of the body of the lock 140, and is rotatable with the key that is inserted in the lock.

FIGS. 12 and 13 show the cam bar actuator 146 that is adapted to be rotated with the member 144 when the key inserted in the lock is turned. The actuator 146 has a rectangular keyway 148 to receive the member 144, and a projecting finger 150 that is parallel to the keyway 148. Briefly, with reference to FIG. 2 wherein the cam bar 36 is provided with the oblong opening 110, provisions are made for assembly of the handle of the invention with the key lock and actuator so the finger 150 on the actuator 146 (FIGS. 9–13) extends into the opening 110, so that turning a key inserted in the lock 140 effects rotational movement of the actuator 146, and thereby longitudinal movement of the cam bar 36 to position the latch plate as in the manner previously described.

To this end, an exterior handle (FIG. 7) is provided with spaced openings 152, 154 in a plate 130' to receive portions of the posts previously described, such handle having a hand grip 132' as the exterior handle shown and described (FIG. 5). In the handle of FIG. 7, the plate 130' has a central opening 156 to receive one end of the housing of the lock 140 of FIG. 9, i.e., the portion of the lock that extends beyong the bar 142 as best seen in FIG. 10.

Referring to FIG. 8, a spacer bar or plate 160 is provided with spaced openings 162, 164 to be aligned with the post receiving openings 152, 154. The plate 160 also has a central opening 166 which, as shown, includes a central circular portion from which wing slots extend. The opening 166 is adapted to receive one end of the bar 142 and the portion of the housing of the lock 140 to which the bar is welded.

FIG. 14 shows the lock 140 in position wherein one end extends through the opening 156 in the handle plate 130', and the one end of the bar 142 and lock housing extends into the opening 166 of the spacer plate 160. The bar 142 may be located in either wing slot of the opening 166, the symmetrical shape of the opening being one that facilitates assembly.

In like fashion, the stile 22' also has an opening 168 that is shaped like the opening 166 in the spacer plate 160. In like fashion, the slots of the openings 166, 168 serve to prevent the lock body from turning when a key is inserted in the lock and turned.

The other end of the lock 140 rests against the inner surface of the inner wall of the stile 22', and the rectangular lock member 144 extends into the slot in the actuator element 146 which, as shown, has its finger 150 located in the opening 110. The inner wall of the stile 22' is provided with an opening 170 that is somewhat larger in diameter than the width of the member 144 so as to provide adequate clearance to permit its turning without binding. Also, such opening 170 receives the projection of the slotted end of the actuator 146, and if desired may serve as a bearing for such projection to aid the desired rotary movement of the actuator. As noted, in this example the cam bar 36 is formed to provide a well 172 of sufficient depth to insure the actuator 146 readily fits therein and against the outer surface of the inner wall of the stile 22'.

Referring to the cam bar 36 shown in FIG. 2 along with FIG. 14, it will be observed that when the actuator 146 is turned, its finger effects longitudinal movement of the cam bar 36. The opening 110 is of sufficient size to prevent the finger 150 from binding therein. Since the opening is elongated, longitudinal movement of the cam bar is facilitated during turning of the actuator 146 because the finger rides from one end of the opening 110 to the other. Thus, the length of the opening 110, along with the size of the finger 150, determines the extent of the longitudinal movement of the cam bar 36. Such movement is that which is needed to effect movement of the latch plate between its open and closed position.

It should be noted that this invention encompasses a variety of structural elements for effecting the desired locking and unlocking movements of the latch plate. Thus, the cam bar 36 may be shaped to accommodate a latch plate that does not have V-shaped ends, but rather inclined spaced walls that extend in the same direction, or inclined ribs or runners, normally resting against inclined surfaces or walls of the cam bar which act upon cam bar movement to cam the latch plate from one to the other of its locking and non-locking positions. The handle may be used with existing exterior hardware, i.e., the inner locking handle may replace the existing inner handle and be fastened to the stile directly or secured together therewith via posts as described after drilling holes through the exterior handle and the inner and outer walls of the stile. The cam bar need not be slotted, but any suitable guides and stops may be utilized to effect and limit the desired travel of the cam bar to effect the desired transverse movement of the latch plate.

I claim:

1. In combination:

an elongated housing having an opening in one wall;

an elongated bar movable longitudinally in said housing;

spring means in said housing;

and an elongated latch plate in said housing disposed between said bar and spring means, said latch plate having spaced portions engageable with the inner surface of said one wall, said latch plate being movable transversely of said bar between the first and second positions, said spring means biasing said latch plate toward said first position in a first position of said bar, said bar in a second position forcing said latch plate to its second position, said latch plate having a latch portion extending through said opening and movable from one side of said opening in the first position of said latch plate to the other side of said opening in the second position of said latch plate, and the ends of said latch portion being engageable with the ends of said opening as said bar is moved between its first and second positions.

2. The combination of claim 1, wherein said bar cams said latch plate to its second position when said bar is moved from its first to its second position, and said spring means moving said latch plate to its first position when said bar is moved from its second to its first position.

3. The combination of claim 2, wherein said spring means is comprised of a bowed leaf spring having its ends engaging said latch plate and its mid-portion abutting a surface in said housing.

4. The combination of claim 3, wherein said latch plate has fingers engaging and interlocking with said spring means.

5. The combination of claim 3, wherein said latch plate at one edge engages the inner surface of said one wall.

6. The combination of claim 4, wherein said leaf spring has an elongated slot therein, and wherein the mid-portion of said leaf spring has a projection engaging a wall surface of said housing opposite said inner surface, said fingers including a pair extending from said one edge of said latch plate which engage the edge of said leaf spring adjacent said one wall, and a pair extending from the opposite edge of said latch plate which engage said leaf spring along the said of said slot remote from said one wall, and said spring being operable as a cushion upon said latch portion being struck to permit said latch plate to retract inwardly of said housing and away from said one wall.

7. In combination with a sash having a stile to be closed against a jamb, a locking handle comprising:

an elongated housing secured to the inner face of the stile, said housing having parallel walls extending from the inner face and bridged by a wall that is parallel to the inner face, the wall of the housing adjacent the end of the stile having an elongated opening therein;

an elongated bar extending through said housing with one end thereof extending out of one end of said housing, said bar being longitudinally movable by manual force against said one end to cause its other end to extend out of the other end of said housing, said bar being movable adjacent said stile;

an elongated flat plate in said housing in a plane parallel to said bridging wall, said plate having a portion extending through said opening;

spring means in said housing between said bridging wall and said plate, said bar and spring means coacting to effect movement of said plate toward and away from the inner face of said stile in different positions of said bar, the portion of said plate extending through said opening being adapted in the position of said plate nearest said stile to latchingly engage the jamb when said stile is closed against the jamb.

8. The combination of claim 7, wherein said bar and said plate have inclined surfaces in interference relation when said bar is moved longitudinally between its positions wherein one end or the other extends from the housing, said bar thereby camming said plate via the inclined surfaces to force said plate towards said bridging wall.

9. The combination of claim 8, including an opening in said bar that extends transversely thereof;

an actuator element having a finger in said transverse opening, said element having a keyway therein spaced from said finger;

a lock having a blade member in said keyway, said lock having a body extending through said stile to the outer face thereof, said lock being adapted to receive a key to be turned for actuating said blade member and effecting angular movement of said actuator element to cause longitudinal movement of said bar to one or the other of its two positions; and an exterior handle member having an opening therein for receiving the outer end of the body of said lock.

10. The combination of claim 8, wherein said inner face of said stile is grooved and the housing wall adjacent the end of said stile matingly fits in one of the grooves; and said plate having one edge engaging the inner surface of said wall.

* * * * *